US007591693B2

(12) United States Patent
Hughes

(10) Patent No.: US 7,591,693 B2
(45) **Date of Patent: *Sep. 22, 2009**

(54) DEVICE AND METHOD FOR LATCHING SEPARABLE INSULATED CONNECTORS

(75) Inventor: David C. Hughes, Rubicon, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/789,426

(22) Filed: Apr. 23, 2007

(65) Prior Publication Data

US 2008/0045091 A1 Feb. 21, 2008

Related U.S. Application Data

(63) Continuation-in-part of application No. 11/034,588, filed on Jan. 13, 2005, now Pat. No. 7,258,585.

(51) Int. Cl.
*H01R 11/22* (2006.01)

(52) U.S. Cl. ..... 439/848; 439/185; 439/921

(58) Field of Classification Search ..... 439/181, 439/185, 186, 187, 921, 349, 843, 851, 848, 439/593

See application file for complete search history.

(56) References Cited

U.S. PATENT DOCUMENTS

| | | | |
|---|---|---|---|
| 278,346 | A | 5/1883 | Long |
| 2,944,241 | A | 7/1960 | Londell, Jr. |
| 3,161,451 | A | 12/1964 | Neidecker |
| 3,493,917 | A | 2/1970 | Glowacz |
| 3,539,972 | A | 11/1970 | Silva et al. |
| 3,654,590 | A | 4/1972 | Brown |
| 3,725,846 | A | 4/1973 | Strain |
| 3,798,586 | A | 3/1974 | Huska |
| 3,945,699 | A | 3/1976 | Westrom |
| 4,088,383 | A | 5/1978 | Fischer et al. |
| 4,443,054 | A | 4/1984 | Ezawa et al. |
| 4,820,183 | A | 4/1989 | Knapp et al. |

(Continued)

FOREIGN PATENT DOCUMENTS

| | | |
|---|---|---|
| DE | 31 10 609 | 10/1982 |

(Continued)

OTHER PUBLICATIONS

International Search Report and Written Opinion for International Appl. No. PCT/US2008/061170, mail date Sep. 12, 2008, 17 pages.

(Continued)

*Primary Examiner*—Tho D Ta
(74) *Attorney, Agent, or Firm*—Foley & Lardner LLP

(57) ABSTRACT

A latching mechanism for joining separable insulated connectors employs a plurality of finger contacts to create an interference fit with an electrode probe of an elbow connector. The electrode probe enters a cylindrical grouping of the plurality of finger contacts and a projection causes an interference fit between the finger contacts and the electrode probe. The finger contacts latch the connectors together and require a removal force greater than the latching force required to latch the connectors. The latching mechanism provides a multi-point current path between an elbow connector and a power transmission or distribution apparatus and provides operator feedback to indicate the latching of the mechanism.

36 Claims, 4 Drawing Sheets

U.S. PATENT DOCUMENTS

| | | | | |
|---|---|---|---|---|
| 5,025,121 | A | | 6/1991 | Allen et al. |
| 5,041,027 | A | * | 8/1991 | Lien ..... 439/796 |
| 5,468,164 | A | | 11/1995 | Demissy |
| 5,846,093 | A | | 12/1998 | Muench et al. |
| 5,857,862 | A | | 1/1999 | Muench et al. |
| 6,744,255 | B1 | | 6/2004 | Steinbrecher et al. |
| 7,182,647 | B2 | | 2/2007 | Muench et al. |
| 2004/0121657 | A1 | | 6/2004 | Muench et al. |
| 2006/0154507 | A1 | | 7/2006 | Hughes et al. |

FOREIGN PATENT DOCUMENTS

| | | |
|---|---|---|
| DE | 35 21 365 C1 | 2/1987 |
| EP | 0066441 | 12/1982 |
| FR | 2 508 729 | 12/1982 |
| FR | 2508729 | 12/1982 |
| GB | 105 227 | 2/1918 |
| WO | WO 2006/076359 | 7/2006 |

OTHER PUBLICATIONS

Cooper Power Systems Product Literature — Loadbreak Apparatus Connectors, 200 A 25kV Class Loadbreak Bushing Insert (1 sheet); May 2003.

Cooper Power Systems Product Literature — Loadbreak Apparatus Connectors, 200 A 25 kV and 28 kV Class — Expanded Range Loadbreak Elbow Connector Canadian Standards Edition (6 sheets); Feb. 2002.

Cooper Power Systems Product Literature — Deadbreak Apparatus Connectors, 600 A 15/25 kV Class Bol-T Deadbreak Connector (6 sheets); Aug. 2002.

Cooper Power Systems — Product Literature — OEM Equipment, 600 A 15 and 25 kV Class Deadbreak Apparatus Bushing (3 sheets); Jan. 1990.

Cooper Power Systems Product Literature — Deadbreak Apparatus Connectors, 600 A 15/25 kV Class PUSH-OP Insulated Standoff Bushing (2 sheets); Aug. 2002.

Cooper Power Systems Product Literature — Molded Rubber Products, 600 A 25 kV Class PUSH-OP Deadbreak Connector (5 sheets); Mar. 1991.

* cited by examiner

DEVICE AND METHOD FOR LATCHING SEPARABLE INSULATED CONNECTORS

CROSS REFERENCE

The present application claims the benefit of priority as a continuation in part patent application under 35 U.S.C. §120 to U.S. patent application Ser. No. 11/034,588 entitled "Device and Method for Latching Separable Insulated Connectors" filed on Jan. 13, 2005, which is incorporated by reference in its entirety.

FIELD

The present application relates generally to the field of separable insulated connectors. More particularly, this application relates to enhancements in latching mechanisms for separable insulated connectors.

RELATED ART

Separable insulated connectors provide the interconnection between energy sources and energy distribution systems. Typically, energy distribution is made possible through a large voltage distribution system, which results in power distribution to homes, businesses, and industrial settings throughout a particular region. In most cases, the distribution of power begins at a power generation facility, such as a power plant. As the power leaves the power plant, it enters a transmission substation to be converted up to extremely high voltages for long-distance transmission, typically in the range of 150 kV to 750 kV. Then power is transmitted over high-voltage transmission lines and is later converted down to distribution voltages (within 2 kV to 10 kV) that will allow the power to be distributed over short distances more economically. The power is then reduced from the distribution voltage, typically around 7,200 volts, and delivered over a distribution bus line to the 240 volts necessary for ordinary residential or commercial electrical service.

The electrical connectors typically involved in power distribution at the switchgear level, known as separable insulated connectors, typically consist of a male connector and a female connector. The mating of the male and female connectors are necessary to close the electrical circuit, for distribution of power to customers. The female connector is typically a shielding cap or an elbow connector that mates with a male connector. The male connector is generally a loadbreak bushing that typically has a first end adapted for receiving a female connector (e.g., an elbow connector or shielding cap) and a second end adapted for connecting to a bushing well stud. The first end of the male connector is an elongated cylindrical member with a flange on the rim of the member. The flange allows for an interference fit between the bushing and the mating elbow connector. The flange secures the bushing to a groove in the inner wall of the mating elbow connector. The interference fit and the flange-groove mechanism are typical mating methods for a male and female connector.

Positioned within the male and female connectors are female and male contacts, respectively. The male contact is typically an electrode probe. The female contact is typically a contact tube with a plurality of finger contacts, which mate with the electrode probe from the female connector. When the male and female contacts mate, the electrical circuit is closed.

The mating of most separable insulated connectors is typically accomplished by an interference-fit rubber latch mechanism to secure an elbow connector with a bushing. Typically, the latch mechanisms of the connectors are lubricated to prevent the connectors from bonding together. To avoid the inadvertent bonding, line-crew operators often over-lubricate the rubber fittings. Typically, these interference-fit latch mechanisms may become unlatched due to over lubrication of the latch ring geometry, which is referred to as the hydraulic effect.

Many separable insulated connectors provide a visual indicator band, of a contrasting color, for notification that an elbow connector is unlatched from a bushing. However, an elbow connector can subsequently become unlatched after it is connected with the bushing, due to the hydraulic effect between the elbow connector and the bushing. This occurrence can be the result of numerous factors, one factor being the low removal force typically required to unlatch mating connectors.

Accordingly, it would be advantageous to provide a latching mechanism that exhibits a reduced probability of becoming inadvertently unlatched. Also, it would be advantageous to provide a latching mechanism that requires a force for removing the electrode probe to be greater than the force for latching the electrode probe. Additionally, it would be advantageous to provide a latching mechanism that produces audible notification of latching between the mating separable insulated connectors. It would advantageous to provide a latching mechanism having consistent physical properties over a broad range of temperatures, resulting in more consistent latching performance. Also, it would be advantageous to provide a latching mechanism with an electrode probe having an outside diameter larger than the inside diameter of the finger contacts, resulting in optimal contact pressure and improved current ratings. Lastly, it would be advantageous to provide a latching mechanism having an electrode probe with a first and second recessed area for latching with a plurality of finger contacts. It would be desirable to provide a latching mechanism or the like of a type disclosed in the present application that includes any one or more of these or other advantageous features. It should be appreciated, however, that the teachings herein may also be applied to achieve devices and methods that do not necessarily achieve any of the foregoing advantages but rather achieve different advantages.

SUMMARY

One exemplary embodiment pertains to a latching mechanism for a separable insulated connector. A latching mechanism, in accordance with an exemplary embodiment comprises a cylindrically-shaped electrode probe and a bushing. The electrode probe includes one of either a recessed area or a projection, and the bushing includes a plurality of cylindrically-grouped finger contacts having the alternative one of the recessed area or the projection. The plurality of finger contacts are configured to receive the electrode probe, wherein the electrode probe and the plurality of finger contacts mate by latching the projection into the recessed area.

In accordance with another exemplary embodiment, a mechanism and method comprise latching an electrode probe with a plurality of finger contacts in a separable insulated connector, wherein, during the latching of the electrode probe and the plurality of finger contacts, the electrode probe enters a cylindrical grouping of the plurality of finger contacts and a projection causes an interference fit between the plurality of finger contacts and the electrode probe.

In accordance with another exemplary embodiment, a system comprises a high-voltage power transmission or distribution apparatus. The system further comprises an elbow connector, including a first insulated housing and an electrode probe including one of either a recessed area or a projection. The system further comprises a bushing, including a second insulated housing, a conductive layer, and a plurality of finger contacts including the other one of the recessed area or the projection, wherein the finger contacts and the electrode probe mate by latching the projection into the recessed area.

In accordance with another exemplary embodiment, a method comprises latching an electrode probe of an elbow connector with a plurality of finger contacts in a separable insulated connector, the latching being performed by a projection and a recessed area, wherein the projection latches into the recessed area, providing operator feedback indicating that the separable insulated connector is latched.

In accordance with another exemplary embodiment, a method comprises latching an electrode probe with a plurality of finger contacts in a separable insulated connector, the electrode probe including one of either a recessed area or a projection and the finger contacts including the other one of the recessed area or the projection, wherein the latching of the electrode probe with the plurality of finger contacts requires an insertion force lower than the force required for unlatching the electrode probe with the plurality of finger contacts.

Still other advantages of the present invention will become readily apparent to those skilled in this art from review of the enclosed description, wherein the preferred embodiment of the invention is disclosed, simply by way of the best mode contemplated, of carrying out the invention. As it shall be understood, the invention is capable of other and different embodiments, and its several details are capable of modifications in various respects, all without departing from the invention. Accordingly, the figures and description shall be regarded as illustrative in nature, and not as restrictive.

DETAILED DESCRIPTION OF THE PREFERRED EMBODIMENTS

Figure 1:
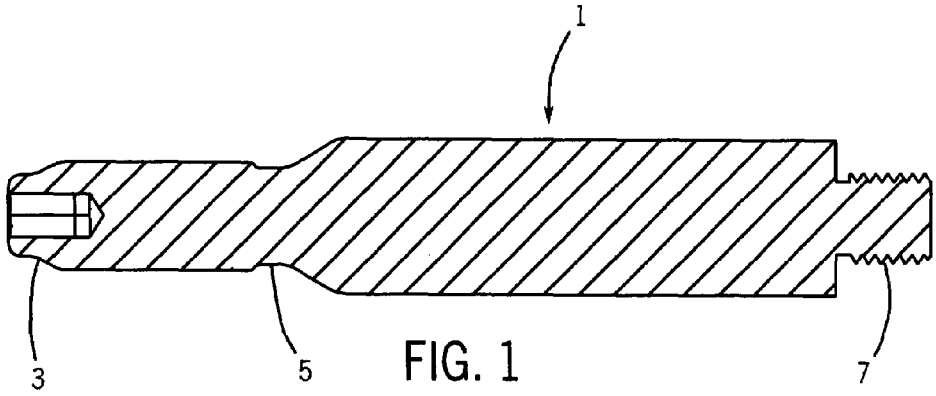
FIG. 1 is a cross-sectional view of an electrode probe with a recessed middle area and a recessed tip.

Referring to FIG. 1, electrode probe 1 is illustrated as a cylindrical member with recessed tip 3 near a first end of electrode probe 1, wherein the cylindrical member may be in the form of a rod or tube. In a circuit closing operation, recessed tip 3 is the first section of electrode probe 1 to connect with finger contacts 11 (shown in FIGS. 2 and 3). Recessed tip 3 is contoured to penetrate into the grouping of finger contacts 11 (shown in FIG. 5). Electrode probe 1 also has recessed area 5 near the middle of the cylindrical body of electrode probe 1. Recessed area 5 provides a contact point for interlocking electrode probe 1 with finger contacts 11 (shown in FIG. 5).

Threaded base 7 is positioned at a second end of the cylindrical body of electrode probe 1, opposite recessed tip 3 of electrode probe 1. Threaded base 7 is recessed from the general radius of electrode probe 1, and threaded base 7 provides electrode probe 1 with a connection to the power cable of an elbow connector.

In one embodiment, electrode probe 1 and finger contacts 11 may comprise metal or a similar conductive material. In another embodiment, electrode probe and finger contacts 11 preferably comprise a conductive material having consistent physical properties, wherein the conductive material is less affected by varying temperatures and will provide consistent performance in a broad range of temperatures.

Figure 2:
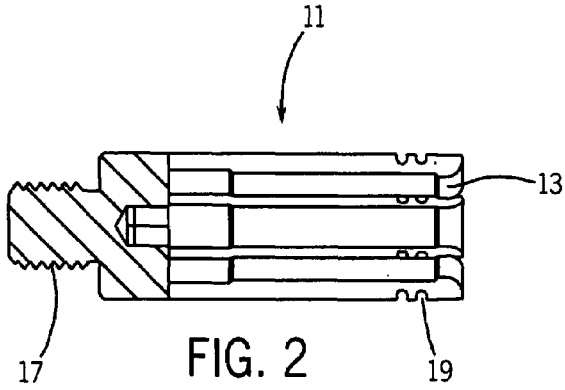
FIG. 2 is cross-sectional view of a cylindrical grouping of finger contacts with a plurality of recessed grooves on the external surface of each finger contact.

Referring now to FIG. 2, a plurality of finger contacts 11 is illustrated as a cylindrical grouping for mating with electrode probe 1. Each finger contact 11 has a projection 13 near a first end of each finger contact 11. Projection 13 is a protrusion on the inner surface of each finger contact 11 that provides a contact point for each finger contact 11 to interlock with recessed area 5 of electrode probe 1 when fully latched together. As electrode probe 1 is inserted into a plurality of finger contacts 11 during a loadbreak operation, electrode probe 1 slides into the grouping of finger contacts 11 by riding on projection 13 of each finger contact 11 (shown in FIG. 4). Projection 13 provides a reduced surface area over which electrode probe 1 must traverse in order to make full connection with the plurality of finger contacts 11.

Figure 3:
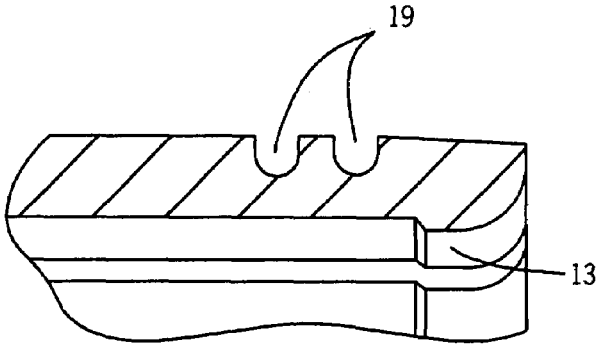
FIG. 3 is an enlarged cross-sectional view of a single finger contact exhibiting a plurality of recessed grooves in the external surface of the finger contact.

FIGS. 2 and 3 also illustrate a plurality of recessed grooves 19 on the external surface of each finger contact 11. Each recessed groove 19 is an indentation formed in the external surface of each finger contact 11. Each recessed groove 19 can house an expandable retention spring (shown in FIGS. 4, 5, and 6), for restricting the flexibility of finger contacts 11. FIG. 3 provides an enlarged illustration of recessed grooves 19 and projections 13 on a single finger contact 11. FIG. 2 also illustrates threaded base 17 positioned at the second end of finger contacts 11, opposite the plurality of projections 13 on finger contacts 11. Threaded base 17 is recessed from the general radius of the body of finger contacts 11, and threaded base 17 provides finger contacts 11 with a connection to bushing well stud of a switchgear.

Figure 4:
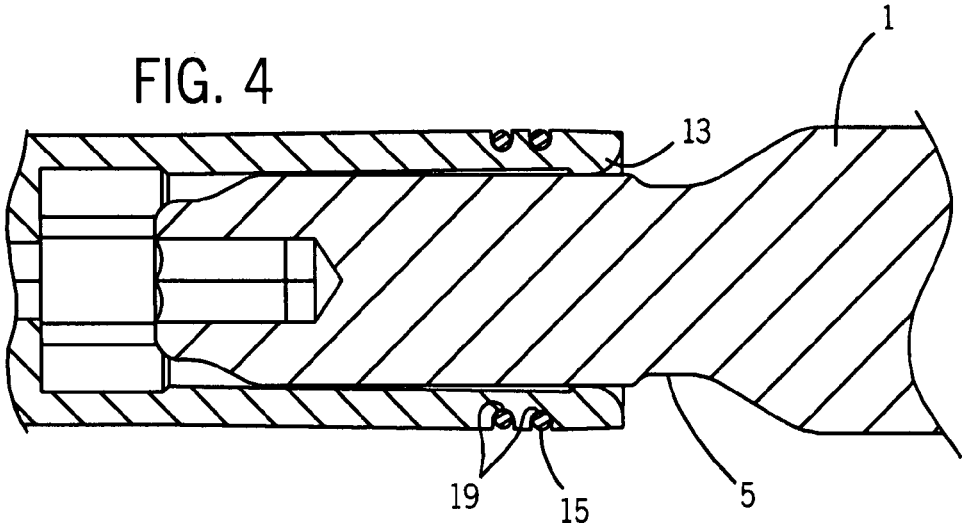
FIG. 4 is a cross-sectional view of a latching mechanism, with an electrode probe mating with finger contacts and the electrode probe riding on the projection of the finger contacts during the latching process.
Figure 5:
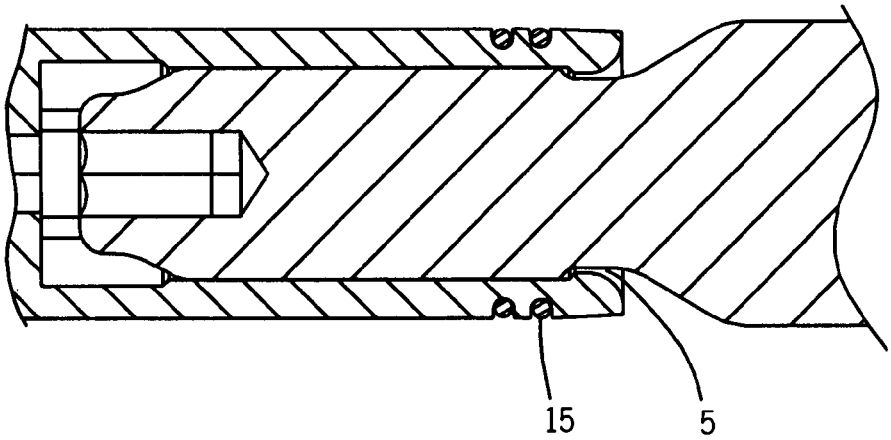
FIG. 5 is a cross-sectional view of the latching mechanism, with an electrode probe and finger contacts latched together by the projections being seated in a recessed area of the electrode probe.

FIGS. 4 and 5 illustrate the penetrating and latching of electrode probe 1 into finger contacts 11. As shown in FIG. 4, electrode probe 1 penetrates into the plurality of finger contacts 11 and slides into the central common area of finger contacts 11 by riding on the plurality of projections 13. The plurality of projections 13 allows electrode probe 1 to slide into finger contacts 11, requiring a reduced amount of force and friction for inserting electrode probe 1 into finger contacts 11. In one embodiment, each projection 13 may be formed with a rounded face and a backside comprising a ridge angled steeper than the rounded face on the front-side of projection 13. The ridge of projection 13 is sloped closer to perpendicular to the axis of motion of electrode probe 1 than the rounded face of projection 13. The rounded face of projection 13 allows electrode probe 1 to slide into the plurality of finger contacts 11 with minimal resistance and reduced friction. As recessed tip 3 of electrode probe 1 converges with the rounded face of projection 13, recessed tip 3 glides into finger contacts 11 due to the minimal friction with the rounded face of projection 13. Conversely, the backside of projection 13 comprises a ridge for latching electrode probe 1 into finger contacts 11. Upon seating of electrode probe 1 within finger contacts 11, the ridge of projection 13 locks into recessed area 5. The ridge of projection 13 comprises a steeper angle than the rounded face on the front-side of projection 13, which results in requiring a greater removal force for electrode probe 1 from the plurality of finger contacts 11 than the required insertion force. The plurality of projections 13 allows the force required for latching a connector to be lower than the force required to unlatch the same connector.

In another embodiment, the angle of the front-side and backside of projection 13 may be configured to accomplish latching and unlatching of the separable insulated connectors with varying levels of force. The angle of projection 13 and recessed area 5 may be configured such that upon applying a requisite force to separate electrode probe 1 from finger contacts 11, the force would be sufficient to remove electrode probe 1 and preferably reduces the likelihood of arcing resulting from slowly separating electrode probe 1 and finger contacts 11. Additionally, in yet another embodiment, the angle and configuration of recessed tip 3 and projections 13 may be adjusted to accomplish latching the separable insulated connectors with varying levels of force. The configuration of recessed tip 3 may be adjusted such that upon applying a requisite force to insert electrode probe 1 into the common area of the plurality of finger contacts 11, there is sufficient force to slide electrode probe 1 into a fully latched position in finger contacts 11. Such an embodiment preferably reduces the likelihood of experiencing line to ground faults or connector back-offs. In another embodiment, the separable insulated connector may be configured to aid-in or facilitate a fault closure. During a fault close operation, the latching mechanism of electrode probe 1 and finger contacts 11 can prevent electrode probe 1 from springing out of the closed position. Such an embodiment enables the latching mechanism to properly engage during a high-current operation, thereby improving the likelihood of a successful fault closure.

Figure 6:
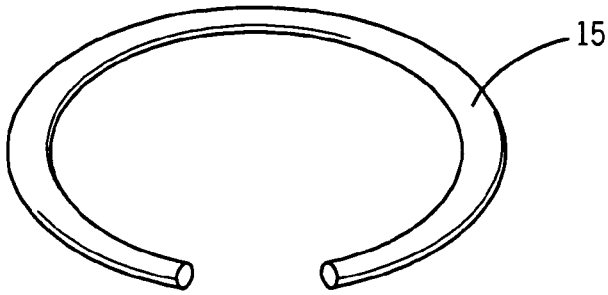
FIG. 6 is a three-dimensional view of a retention spring that can be seated in the recessed grooves of the finger contacts.

When electrode probe 1 is inserted into finger contacts 11, the grouping of finger contacts 11 expands outwardly due to the springiness of each finger contact 11. In order to increase the contact pressure of each finger contact 11, recessed grooves 19 on the external surface of each finger contact 11 house retention springs 15. FIG. 6 illustrates a retention spring 15 as a flexible, circular member, capable of expanding or contracting based on the applied force. Referring back to FIG. 4, as finger contacts 11 expand outwardly, retention spring 15 preferably limits the resilience of each finger contact 11, thus making the structure more rigid.

In one embodiment, optimal contact pressure may be achieved by providing electrode probe 1 with an outside diameter greater that the inside diameter of the current carrying area of the grouping of finger contacts 11. Preferably, the current carrying area of finger contacts 11 includes the central common area of finger contacts 11 including the elongated portion shown in FIGS. 2, 4, and 5. In such a case, recessed tip 3 is preferably configured to wedge finger contacts 11 outward. Retention spring 15 may be positioned on the external surface of finger contacts 11. Finger contacts 11 may be configured to serve as a moment arm thereby increasing the compression force of retention spring 15 on recessed tip 3 of electrode probe 1. The compression force creates an optimal contact pressure with electrode probe 1, thereby generating improved current ratings for the system.

Also, as shown in FIG. 4, electrode probe 1 touches each finger contact 11 primarily just on the surface of each projection 13, until each projection 13 reaches recessed area 5 of electrode probe 1. When each projection 13 is seated in recessed area 5 of electrode probe 1, electrode probe 1 is fully latched into the plurality of finger contacts 11. The mating of the electrode probe 1 and the plurality of finger contacts 11 produces an audible sound to denote latching of the mating interfaces. As electrode probe 1 rides on the surface of projection 13, finger contacts 11 are expanded outwardly due to the springiness of each finger contact 11. When the plurality of projections 13 reach recessed area 5, finger contacts 11 immediately contract from their expanded position. The contraction of finger contacts 11 snaps projections 13 into recessed area 5, thus creating an audible sound indicating that projections 13 are seated in recessed area 5. Electrode probe 1 is latched into finger contacts 11 when recessed area 5 and projections 13 make contact and are interlocked, as illustrated in FIG. 5. The audible sound may be an audible click, ring, or any audible notification loud enough to be heard by the unaided ear from a distance of at least four (4) feet to ten (10) feet, in order to audibly indicate latching of the interfaces to a lineman using a live-line tool.

Figure 7:
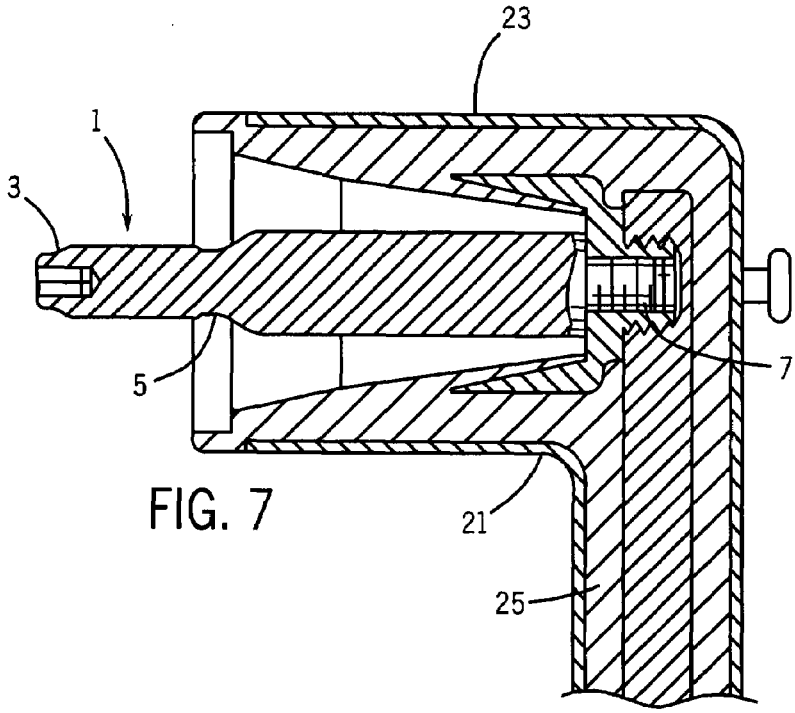
FIG. 7 is a cross-sectional view of an elbow connector with an electrode probe.

Referring to FIG. 7, elbow connector 21 is illustrated with electrode probe 1. Elbow connector 21 is housed in external insulated housing 23 and has an axial bore therethrough providing a hollow center for mating with bushing 31 (shown in FIG. 8). Insulated housing 33 is typically composed of a rubber compound; however, the housing is capable of other compositions. Insulated housing 33 provides a durable protective covering for electrode probe 1. Electrode probe 1 is positioned within elbow connector 21 and is secured in place by threaded base 7. Threaded base 7 provides electrode probe 1 with a connection to power cable 25 of elbow connector 21. FIG. 7 also illustrates recessed area 5 and recessed tip 3 (also shown in FIG. 1). Recessed tip 3 is curved in order to penetrate into a grouping of finger contacts 11, and recessed area 5 provides a contact point for latching electrode probe 1 with finger contacts 11 and also for conducting current between elbow connector 21 and a bushing well stud.

Figure 8:
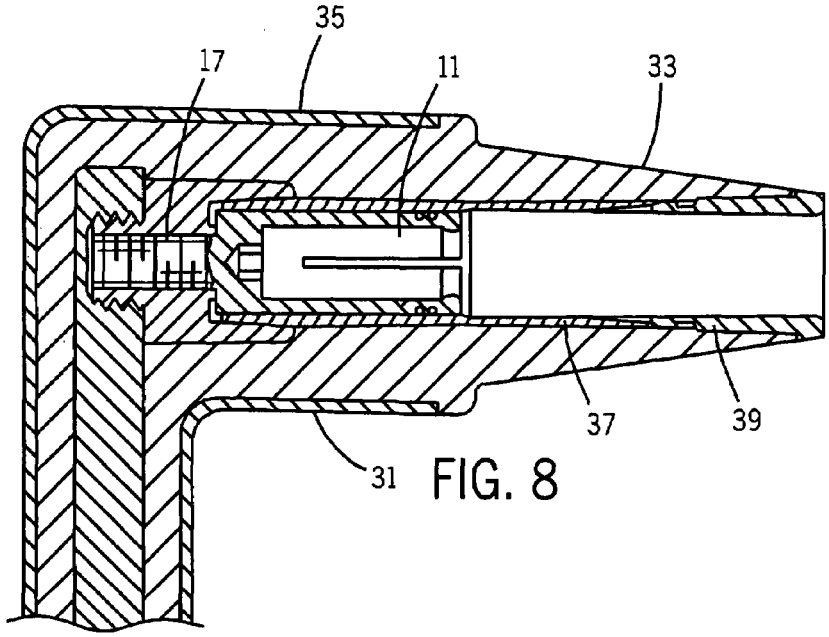
FIG. 8 is a cross-sectional view of a bushing with a grouping of finger contacts for mating with an electrode probe.

Referring to FIG. 8, bushing 31 is illustrated with a plurality of finger contacts positioned within. Bushing 31 is housed in insulated housing 33. Insulated housing 33 is also typically composed of a rubber compound; however, the housing is also capable of other compositions. Insulated housing 33 has a first and second end. The first end is an elongated cylindrical member for mating with elbow connector 21 and the second end is adapted for connecting to a bushing well stud.

The middle section of insulated housing 33, typically referred to as semi-conductive shield 35, is positioned between the first end and second end. The middle section is preferably comprised of a semi-conductive material that provides a deadfront safety shield. Positioned within the bore of insulated housing 33 is an internal conductive layer 37 layered close to the inner wall of insulated housing 33. Internal conductive layer 37 preferably extends from near both ends of insulated housing 33 to facilitate optimal current flow. Positioned within internal conductive layer 37 is internal insulative layer 39, which provides insulative protection to conductive layer 37.

Further positioned within the axial bore of bushing 31 are a plurality of finger contacts 11. Finger contacts 11 provide a multi-point current path between electrode probe 1 (shown in FIGS. 1, 4, 5, and 7) and a bushing well stud. When elbow connector 21 is mated with a bushing 31, electrode probe 1 enters into bushing 31, to connect with finger contacts 11 for continuous current flow. As shown in FIGS. 2, 3, and 4, each finger contact 11 has a projection 13 that allows electrode probe 1 to rest on while sliding into the central common area of finger contacts 11. Once electrode probe 1 has become completely seated within finger contacts 11, each projection 13 latches into recessed area 5 of electrode probe 1 (shown in FIG. 5). Also, threaded base 17 is positioned at the end of finger contacts 11, opposite projections 13. Threaded base 17 is recessed from the general radius of the body of finger contacts 11 and provides finger contacts 11 with a secure connection for current conductance to bushing 31.

Figure 9:
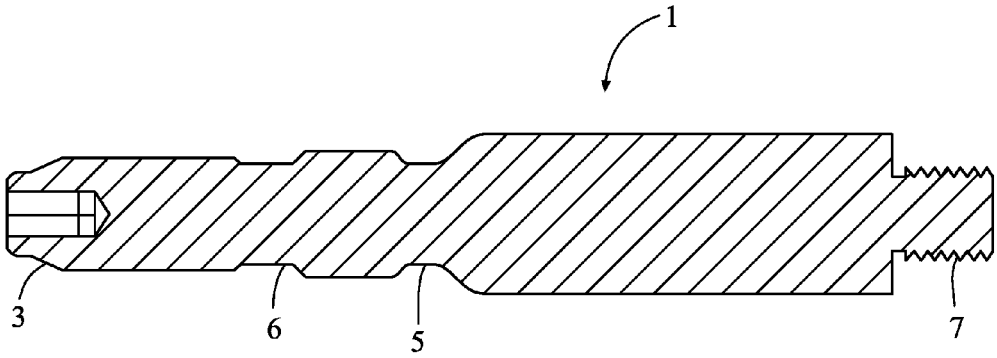
FIG. 9 is a cross-sectional view of an electrode probe with a first and second recessed area and a recessed tip.

In another embodiment, electrode probe 1 may be configured as a cylindrical member with a first and second recessed area (5, 6) for receiving projections 13 of finger contacts 11. Referring to FIG. 9, electrode probe 1 is illustrated as a cylindrical member with recessed tip 3 near a first end of electrode probe 1, wherein the cylindrical member may be in the form of a rod or tube. Recessed tip 3 is contoured to penetrate into the grouping of finger contacts 11. Electrode probe 1 also has a first recessed area 5 near the middle of the cylindrical body of electrode probe 1. First recessed area 5 provides a contact point for interlocking electrode probe 1 with finger contacts 11. Second recessed area 6 is positioned between first recessed area 5 and recessed tip 3. Second recessed area 6 provides an additional contact point for electrode probe 1. Particularly, second recessed area 6 may serve as a contact point when the separable insulated connectors may need to be manually separated. In some cases, the separable insulated connectors may need to be pried, forced apart, or slowly separated from each other due to bonding resulting from the effects of varying temperature, lubricant bonding, equipment aging/wear, etc. In such cases, the projections of finger contacts 11 may become seated in second recessed area 6 while the connectors are being separated and still carrying current. By providing second recessed area 6, the connectors may be separated from a bonded state while still passing current and therefore supplying power to utility customers. With projections 13 being positioned in second recessed area 6, the separable insulated connectors can be separated more easily without resulting in teasing of the contacts of the connectors and thereby reducing the likelihood of arcing. In such an embodiment, by positioning projections 13 in second recessed area 6, sufficient force must be employed to remove projections 13. The amount of force required to overcome the latching mechanism and remove projections 13 from second recessed area 6 will exceed the minimal force necessary to tease the contacts and will potentially minimize the occurrence of that condition.

Throughout the specification, numerous advantages of exemplary embodiments have been identified. It will be understood of course that it is possible to employ the teachings herein so as to without necessarily achieving the same advantages. Additionally, although many features have been described in the context of a power distribution system comprising multiple cables and connectors linked together, it will be appreciated that such features could also be implemented in the context of other hardware configurations. Further, although certain methods are described as a series of steps which are performed sequentially, the steps generally need not be performed in any particular order. Additionally, some steps shown may be performed repetitively with particular ones of the steps being performed more frequently than others, when applicable. Alternatively, it may be desirable in some situations to perform steps in a different order than described.

Many other changes and modifications may be made to the present invention without departing from the spirit thereof.

What is claimed is:

1. A latching mechanism for a separable insulated connector, comprising:

a cylindrically-shaped electrode probe of an elbow connector, the electrode probe including one of either first and second recessed areas or a projection; and a bushing including a plurality of cylindrically-grouped finger contacts configured to receive the electrode probe, the finger contacts including the other one of the first and second recessed areas or the projection, wherein the electrode probe and the plurality of finger contacts mate by latching the projection into either the first recessed area or the second recessed area.

2. A latching mechanism according to claim 1, wherein the mechanism comprises metal.

3. A latching mechanism according to claim 1, wherein the cylindrically-shaped electrode probe and the plurality of cylindrically-grouped finger contacts each comprise an inside diameter and an outside diameter.

4. A latching mechanism according to claim 3, wherein the outside diameter of the electrode probe is larger than the inside diameter of the plurality of cylindrically-grouped finger contacts.

5. A latching mechanism according to claim 1, wherein the electrode probe comprises a recessed end for engaging the plurality of finger contacts.

6. A latching mechanism according to claim 5, wherein the recessed end of the electrode probe is configured to wedge into the plurality of cylindrically-grouped finger contacts, the finger contacts being configured to be forced apart by the electrode probe.

7. A latching mechanism according to claim 1, wherein the plurality of cylindrically-grouped finger contacts have a series of recessed grooves along an external surface of the plurality of finger contacts.

8. A latching mechanism according to claim 7, further comprising a plurality of retention springs seated in the recessed grooves on the external surface of the plurality of finger contacts for supporting the finger contacts.

9. A latching mechanism according to claim 8, wherein the retention springs provide increased contact pressure on the electrode probe by restricting the flexibility of the plurality of finger contacts.

10. A latching mechanism according to claim 1, wherein the projection comprises a first side and a second side, the first and second sides being configured to generate friction between the projection and the mating recessed area.

11. A latching mechanism according to claim 10, wherein the first side of the projection is angled such that upon applying a requisite force to insert the electrode probe into the plurality of finger contacts, the electrode probe is configured to ride on the surface of the first side of the projection in order to mate the projection into either the first recessed area or the second recessed area.

12. A latching mechanism according to claim 10, wherein second side of the projection is angled such that upon applying a requisite force to remove the electrode probe from the plurality of finger contacts, the electrode probe is configured to ride on the surface of the second side of the projection in order to separate the electrode probe and finger contacts.

13. A method comprising latching an electrode probe with a plurality of finger contacts in a separable insulated connector, wherein, during the latching of the electrode probe and the plurality of finger contacts, the electrode probe enters a cylindrical grouping of the plurality of finger contacts and a projection on one of either the electrode probe or the plurality of finger contacts causes an interference fit between the plurality of finger contacts and the electrode probe;

wherein the other one of the electrode probe or the plurality of finger contacts includes a first recessed area and a second recessed area, the projection being configured to mate with either the first recessed area or the second recessed area.

14. A method according to claim 13, wherein during the latching of the electrode probe and the plurality of finger contacts, the electrode probe wedges into the plurality of cylindrically-grouped finger contacts, the finger contacts being configured to be forced apart by the electrode probe.

15. A method according to claim 13, wherein the second recessed area is configured to house the projection during a loadbreak operation.

16. A method according to claim 13, wherein during the latching of the electrode probe and the plurality of finger contacts, the electrode probe rides on the surfaces of the projection to slide into the finger contacts.

17. A method according to claim 16, wherein after the electrode probe rides on the surfaces of the projection, the projection latches into either the first recessed area or the second recessed area.

18. A system comprising:

a high-voltage power transmission or distribution apparatus;

an elbow connector, including a first insulated housing and an electrode probe including one of either first and second recessed areas or a projection; and a bushing, including a second insulated housing, a conductive layer, and a plurality of finger contacts including the other one of the first and second recessed areas or the projection, wherein the finger contacts and the electrode probe mate by latching the projection into either the first recessed area or the second recessed area.

19. A system according to claim 18, wherein projection is one of a series of projections along a first end of either the plurality of finger contacts or the electrode probe.

20. A system according to claim 18 , wherein the second recessed area is configured to house the projection during a loadbreak operation.

21. A system according to claim 18, wherein the electrode probe and the plurality of finger contacts each comprise an inside diameter and an outside diameter.

22. A system according to claim 21, wherein outside diameter of the electrode probe is larger than the inside diameter of the plurality of finger contacts.

23. A system according to claim 18, wherein the electrode probe comprises a recessed end for engaging the plurality of finger contacts.

24. A system according to claim 23, wherein the recessed end of the electrode probe is configured to wedge into the plurality of finger contacts, the finger contacts being configured to be forced apart by the electrode probe.

25. A system according to claim 18, wherein the plurality of finger contacts have a series of recessed grooves along an external surface of the plurality of finger contacts.

26. A system according to claim 25, further comprising a plurality of retention springs seated in the recessed grooves on the external surface of the plurality of finger contacts for supporting the finger contacts.

27. A system according to claim 26, wherein the retention springs provide increased contact pressure on the electrode probe by restricting the flexibility of the plurality of finger contacts.

28. A method comprising latching an electrode probe of an elbow connector with a plurality of finger contacts in a separable insulated connector, the latching being performed by a projection on one of either the electrode probe or the plurality of finger contacts and first and second recessed areas on the other one of the electrode probe or the plurality of finger contacts, wherein the projection latches into either the first recessed area or the second recessed area, providing operator feedback indicating that the separable insulated connector is latched.

29. A method according to claim 28, wherein the operator feedback comprises an audible sound.

30. A method according to claim 28, wherein during the latching of the electrode probe and plurality of finger contacts, the electrode probe rides on the surfaces of the projection to slide into the finger contacts.

31. A method according to claim 28, wherein the step of latching the electrode probe comprises restricting the springiness of the plurality of finger contacts with a plurality of retention springs seated in a series of recessed grooves on the external surfaces of the plurality of finger contacts.

32. A method according to claim 28, wherein the electrode probe is configured to wedge into the plurality of finger contacts, the finger contacts being configured to be forced apart by the electrode probe.

33. A method comprising latching an electrode probe with a plurality of finger contacts in a separable insulated connector, the electrode probe including one of either first and second recessed areas or a projection and the plurality of finger contacts including the other one of the first and second recessed areas or the projection, wherein the latching of the electrode probe with the plurality of finger contacts requires an insertion force lower than the force required for unlatching the electrode probe with the plurality of finger contacts.

34. A method according to claim 33, wherein the projection comprises a first side and a second side, the first and second sides being configured to generate friction between the projection and the mating recessed area.

35. A method according to claim 34, wherein the first side of the projection is angled such that upon applying a requisite force to insert the electrode probe into the plurality of finger contacts, the electrode probe is configured to ride on the surface of the first side of the projection in order to mate the projection with the recessed area.

36. A method according to claim 34, wherein second side of the projection is angled such that upon applying a requisite force to remove the electrode probe from the plurality of finger contacts, the electrode probe is configured to ride on the surface of the second side of the projection in order to separate the electrode probe and finger contacts.

* * * * *